US006308450B1

(12) United States Patent
Ireblad et al.

(10) Patent No.: US 6,308,450 B1
(45) Date of Patent: Oct. 30, 2001

(54) LOCKING DEVICE

(75) Inventors: Lars Ireblad, Upplands Väsby; Heinz Spiegelberg, Täby, both of (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/265,947

(22) Filed: Mar. 11, 1999

(30) Foreign Application Priority Data

Nov. 9, 1998 (SE) ..... 98 00876
Nov. 9, 1998 (SE) ..... 98 03819

(51) Int. Cl.[7] ..... F41A 17/02
(52) U.S. Cl. ..... 42/70.11; 42/70.02
(58) Field of Search ..... 42/70.02, 70.01, 42/70.11

(56) References Cited

U.S. PATENT DOCUMENTS

| | | | | |
|---|---|---|---|---|
| 1,579,736 | | 4/1926 | Stone . | |
| 3,710,490 | * | 1/1973 | Cornett et al. | 42/70.11 |
| 3,765,115 | | 10/1973 | Johansson et al. . | |
| 4,532,729 | * | 8/1985 | Von Muller | 42/70.02 |
| 5,115,589 | * | 5/1992 | Shuker | 42/70.11 |
| 5,263,348 | | 11/1993 | Wittwer | 70/223 |
| 5,331,759 | | 7/1994 | Marceau et al. | 42/70.11 |
| 5,335,520 | | 8/1994 | Lee | 70/349 |
| 5,357,704 | | 10/1994 | Benkovic | 42/70.11 |
| 5,398,438 | * | 3/1995 | Williams | 42/70.11 |
| 5,680,723 | | 10/1997 | Ruiz | 42/70.11 |
| 5,992,076 | * | 11/1999 | Magnusson | 42/70.11 |

FOREIGN PATENT DOCUMENTS

| | | | | |
|---|---|---|---|---|
| 4009372 | * | 10/1990 | (DE) | 42/70.11 |
| 617184 | | 9/1994 | (EP) . | |
| 505705 | | 9/1997 | (SE) . | |

* cited by examiner

*Primary Examiner*—Stephen M. Johnson

(57) ABSTRACT

A locking device for a weapon is provided. The locking device includes a carrier that is receivable in a holder for an ammunition box of a weapon. The locking device also includes a blocking element, the blocking element being supported by the carrier, the blocking element being mountable in a cartridge chamber of the weapon when the locking device is mounted in the weapon, the blocking element being movable between a released position relative to the cartridge chamber and a locked position relative to the cartridge chamber. The locking device also includes an actuator disposed in the carrier, and a power transmission extending between the blocking element and the actuator. A portion of the blocking element is received in the carrier and is at least partly surrounded by protective material.

15 Claims, 4 Drawing Sheets

LOCKING DEVICE

BACKGROUND AND SUMMARY

The present invention relates to a locking device, especially a cartridge chamber lock, intended to be mounted in a weapon, the device including a carrier, that in active position is intended to be received in the holder for the ammunition box of the weapon, and a blocking element that is supported by the carrier, the blocking element, in mounted position of the locking device, being intended to be mounted in the cartridge chamber, the blocking element assuming either a released position relative to the cartridge chamber or a locked position relative to the cartridge chamber, and that the device further includes an actuator, provided in the carrier, and a power transmission extending between the blocking element and the activating means.

From SE-C-505 705 is previously known a locking device, especially a cartridge chamber lock for a weapon. The device includes a blocking element and a lock cylinder element, the elements being integrated with each other. In the blocking element latches are provided in the shape of balls, the balls being activated by an axially displaceable mandrel to achieve locking positions when the blocking element is mounted in the cartridge chamber. Thereby, the balls cooperate with spherical recesses in the cartridge chamber that is manufactured from a hardened material. In order to prevent boring of the locking device according to SE-C-505 705 the mouths of all recesses or borings in the device are provided with plugs, preferably from hardened steel, the plugs constituting a protection against boring. Further, the device is provided with an extra latch device for a mandrel, the latch device being activated if the lock cylinder is removed. In such a case the mandrel is released, the mandrel being displaced axially by action from a spring and cooperates with a groove of the blocking element.

It is desirable to provide a locking device of the type defined above, the device for a sufficiently long time resisting outer damage directed at removing the locking device in order to enable unjustified use the weapon. Apart from boring the locking device must also for a sufficient long time resist working by a cross-cutting saw.

It is further desirable to ensure that the blocking element is secured in a blocked state even if damage of a locking mechanism of the locking device occurs, e.g. by damaging drilling and removing of the locking mechanism.

The present invention permits overcoming some or all of the drawbacks of the prior art, and permits achieving desired characteristics in locking devices.

According to one aspect of the present invention, a locking device for a weapon is provided. The locking device includes a carrier that is receivable in a holder for an ammunition box of a weapon. The locking device also includes a blocking element, the blocking element being supported by the carrier, the blocking element being mountable in a cartridge chamber of the weapon when the locking device is mounted in the weapon, the blocking element being movable between a released position relative to the cartridge chamber and a locked position relative to the cartridge chamber. The locking device also includes an actuator disposed in the carrier, and a power transmission extending between the blocking element and the actuator. A portion of the blocking element is received in the carrier and is at least partly surrounded by protective material.

BRIEF DESCRIPTION OF THE DRAWINGS

Below a preferred embodiment of the locking device according to the present invention will be described, reference being made to the accompanying drawings, where.

Figure 1:
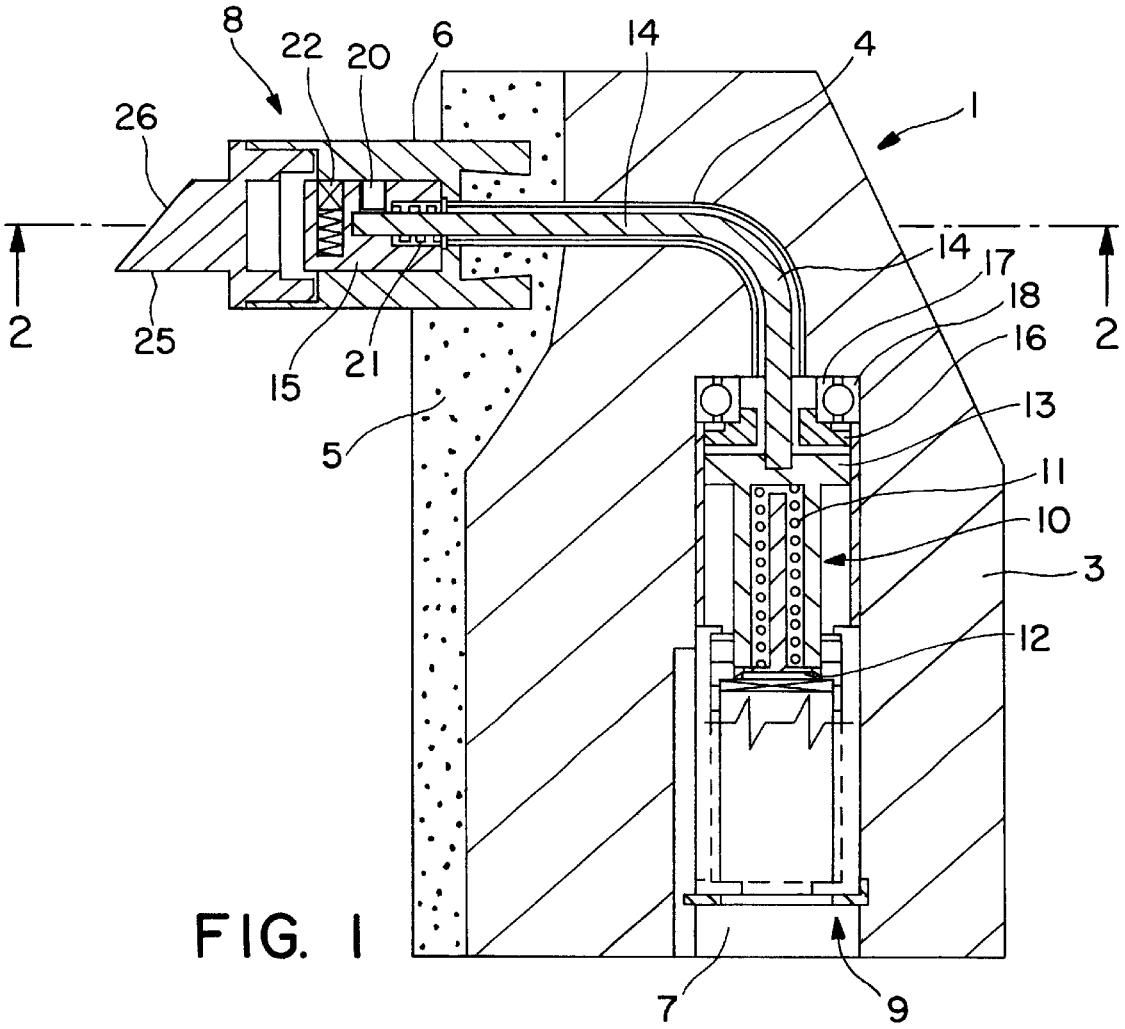
FIG. 1 is a longitudinal section through a locking device according to the present invention, the locking device being in inactive position.
Figure 2:
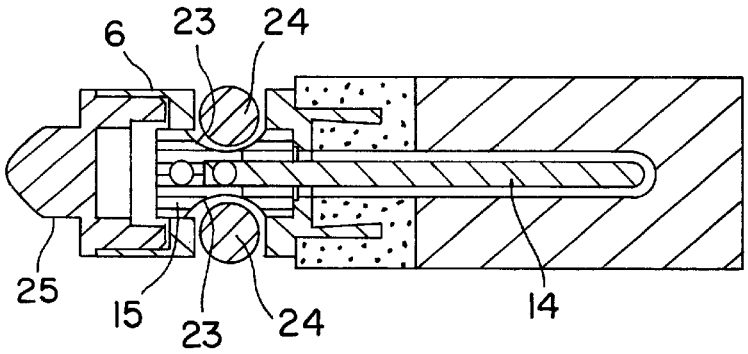
FIG. 2 is a section along 2—2 in FIG. 1.

The locking device according to the present invention, shown in FIGS. 1 and 2, includes a carrier 1 consisting of a composite material that includes a first portion 3 and a second portion 5, the portions being cast integral with each other. The first portion 3 is preferably manufactured from spheroidal graphite iron and the other portion 5 is preferably manufactured from sintered cemented carbide. The composite material may preferably be a material that is marketed under the trademark SANCIC®. The first and second portions 3 and 5 respectively are integrally with each other and preferably manufactured in integral condition by being cast integral with each other as stated above. A casing 6 of a blocking element 8 is embedded in the second portion 5 in connection with casting of the first portion 3 and the second portion 5.

A first recess 7 is provided in the first portion 3, the first recess 7 being effected in connection with casting of the portion 3. A tube 4 extends between the first recess 7 and the casing 6, the tube 4 being attached in connection with the casting of the portions 3 and 5.

In the first recess 7 a locking a mechanism 9, preferably a lock cylinder, is fixedly mounted, e.g. by having the locking mechanism 9 welded in the first recess 7. A releasing device 10 is provided inside of the locking mechanism 9 in the first recess 7, the releasing device 10 being activated if the locking mechanism 9 is removed in an unjustified way, e.g. if the locking mechanism 9 is removed by boring. The releasing device 10 includes among other things a first pressure spring 11 that suitably exerts a pressure force of about 80 N. The first pressure spring 11 acts between a first abutment 12 and an anchoring element 13 of a wire 14 that extends in the tube 4 between the anchoring element 13 and a lock plunger 15 of the blocking element 8, the element 8 will be described more in detail below.

By action from the first pressure spring 11 the anchoring element 13 urges the wire 14 against a second abutment 16 that in its turn abuts the inner ring 17 of a ball bearing whose outer ring 18 is stationary. By introducing a key into the locking mechanism the first abutment 12, the anchoring element 13 and the inner ring 17 may be turned in the first recess 7 and the wire 14 is driven, i.e., it is likewise turned inside the tube 4.

As is most evident from FIG. 1 the wire 14 extends into the lock plunger 15 and is rotationally fixed to the plunger 15 via a locking screw 20. In a second recess in the lock plunger 15 a second pressure spring 21 is provided, the spring 21 being arranged on the outside of the wire 14 and tends to displace the lock plunger 15 to the left in FIG. 1. The second spring 21 suitably exerts a pressure force of about 20 N. The displacement to the left in FIG. 1 is however prevented since the lock plunger 15 is connected with the wire 14 via the locking screw 20. In the lock plunger 15 a spring actuated pin 22 is also received, the pin 22 contacting the bore that receives the lock plunger 15 in the position according to FIG. 1.

From FIG. 2 it is evident that the lock plunger 15 is provided with first recesses 23 that receive locking rollers 24. In the position according to FIG. 2 the locking rollers 24 are received in the first recesses 23 in such a way that the locking rollers 24 are inside of the outer contour of the casing 6.

At the forward end of the casing 6 a front portion 25 is provided, the front portion 25 being connected with the casing 6 via a thread coupling. The front portion 25 has a chamferred forward end 26, see FIG. 1, whose function will be explained below. In the chamferred forward end 26 a cemented carbide pin or the like is preferably provided in order to prevent boring of the blocking element 8 via the barrel of the weapon, see FIG. 3.

Figure 3:
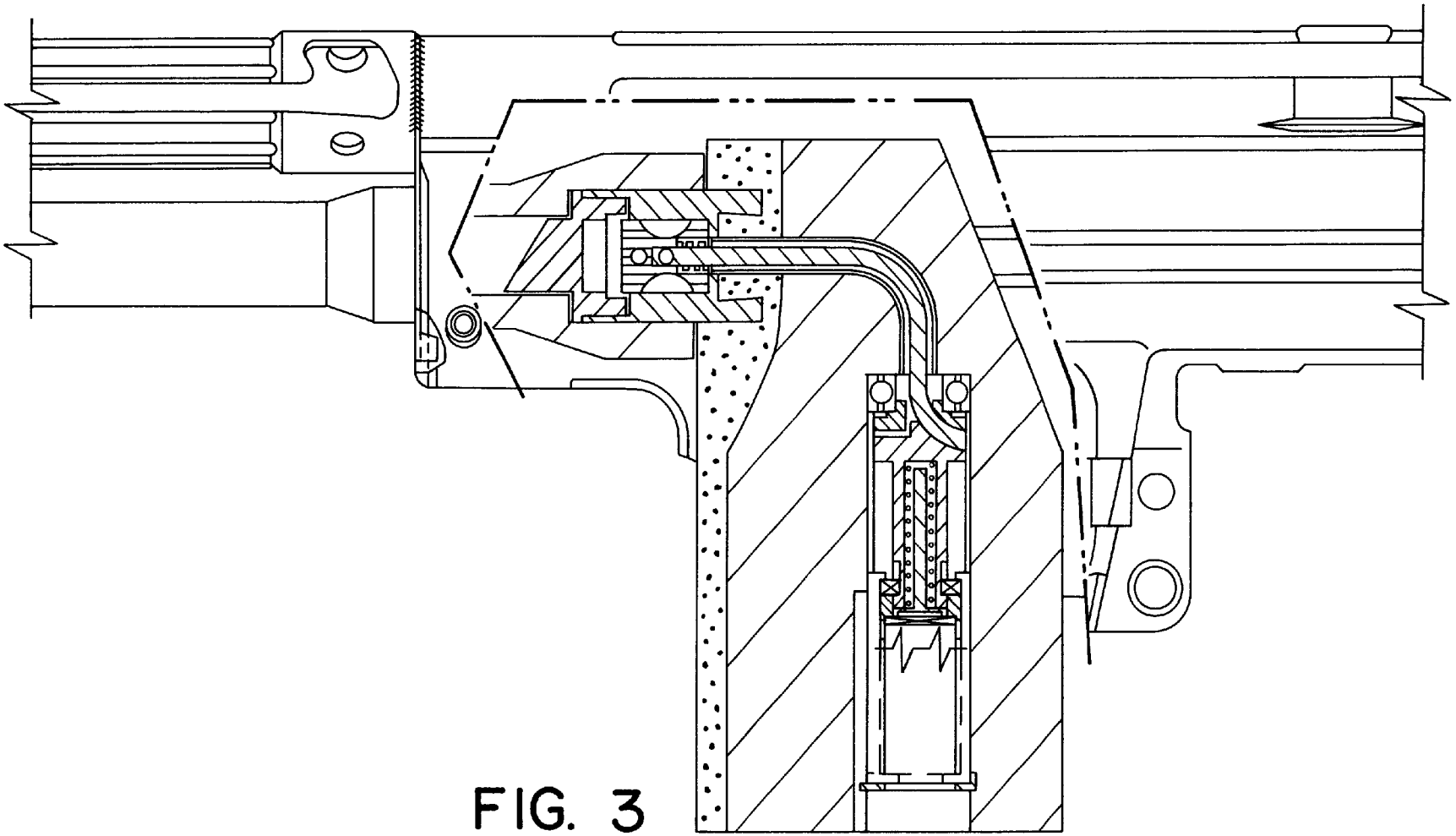
FIG. 3 is a schematic side view of a weapon, the locking device according to the present invention being mounted in the weapon in an activated position.

In FIG. 3 is schematically shown how the locking device according to the present invention is mounted in a weapon, in this case an AK4.

Figure 4:
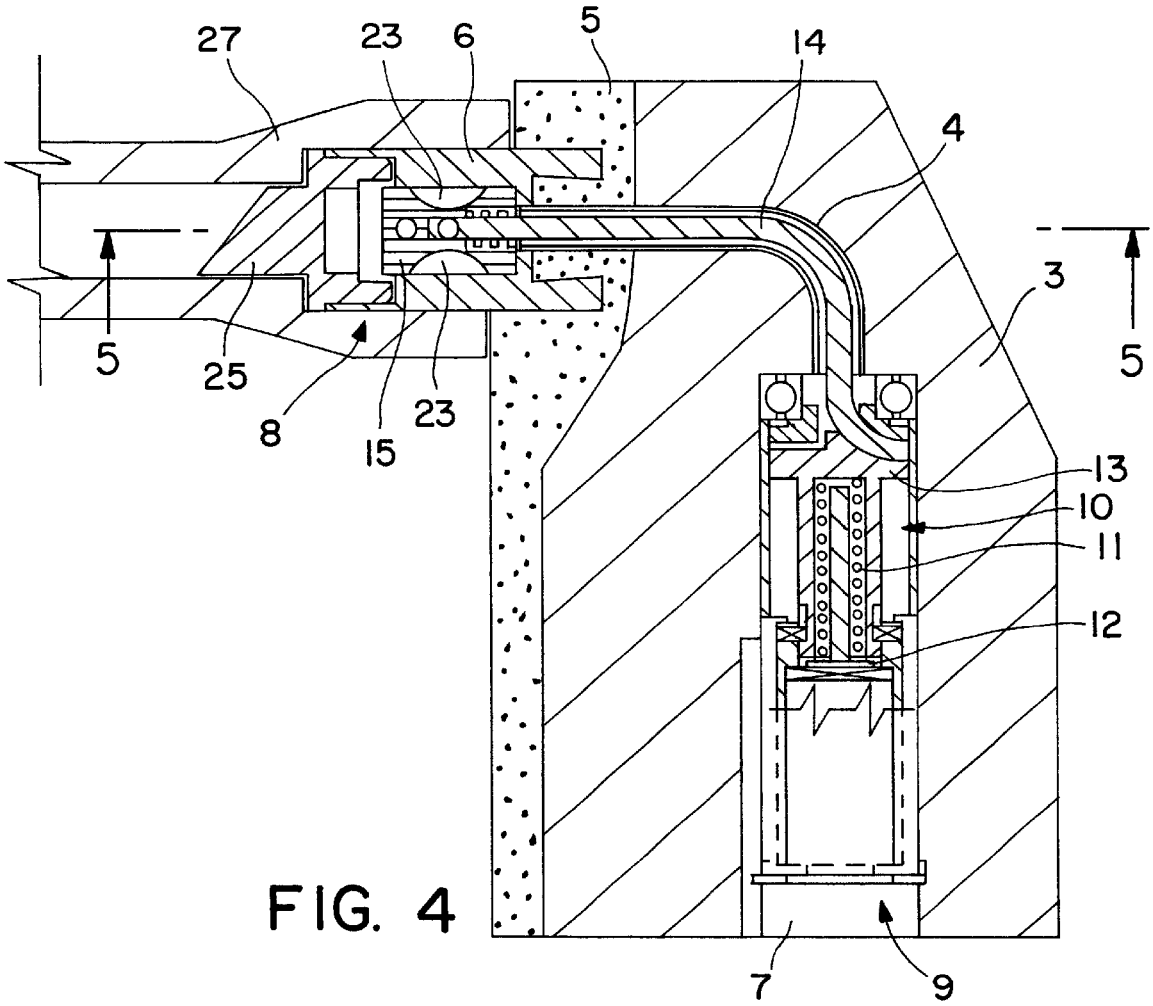
FIG. 4 is a longitudinal section through the locking device according to FIG. 1, the device being mounted in a cartridge chamber of a weapon.
Figure 5:
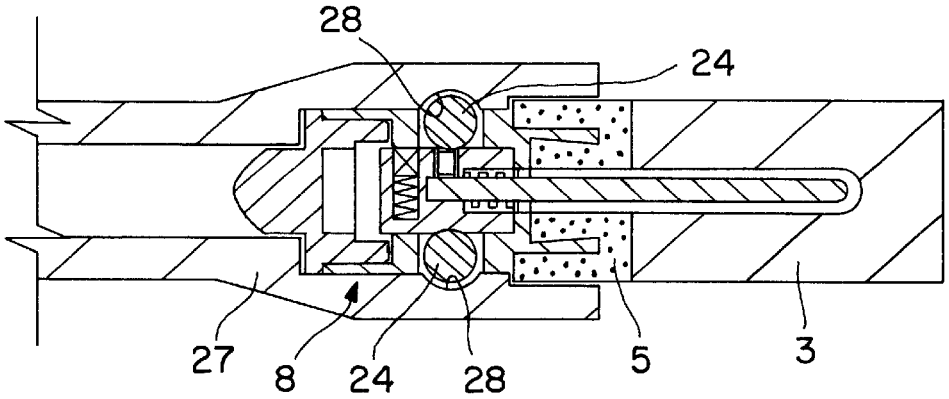
FIG. 5 is a section along 5—5 in FIG. 4.

In FIGS. 4 and 5 is shown how the locking device according to the present invention cooperates with a cartridge chamber 27. When the locking device according to the present invention is in the position according to FIGS. 1 and 2, i.e., the Locking rollers 24 are in the first recesses 23, the locking device is entered through the ammunition box holder and the blocking element 8 is received in the cartridge chamber 27. In this connection it should be pointed out that the chamfering 26 of the front portion 25 serves the purpose to prevent firing of possibly remaining cartridges in the weapon. Then the lock plunger 15 is rotated via the wire 14, i.e., the locking mechanism 9 is activated by a key and the anchoring element 13 is turned 90° thus turning also the wire 14 and the lock plunger 15. The rotated elements are fixed in their new positions by having the anchoring element 13 fixed in its position when the key is removed. Then the locking rollers 24 will co-operate with a cylindrical portion of the lock plunger 15, the locking rollers 24 will be urged out into second recesses 28 in the cartridge chamber 27. Thereby the blocking element 8 is safely secured in the cartridge chamber 27.

Figure 6:
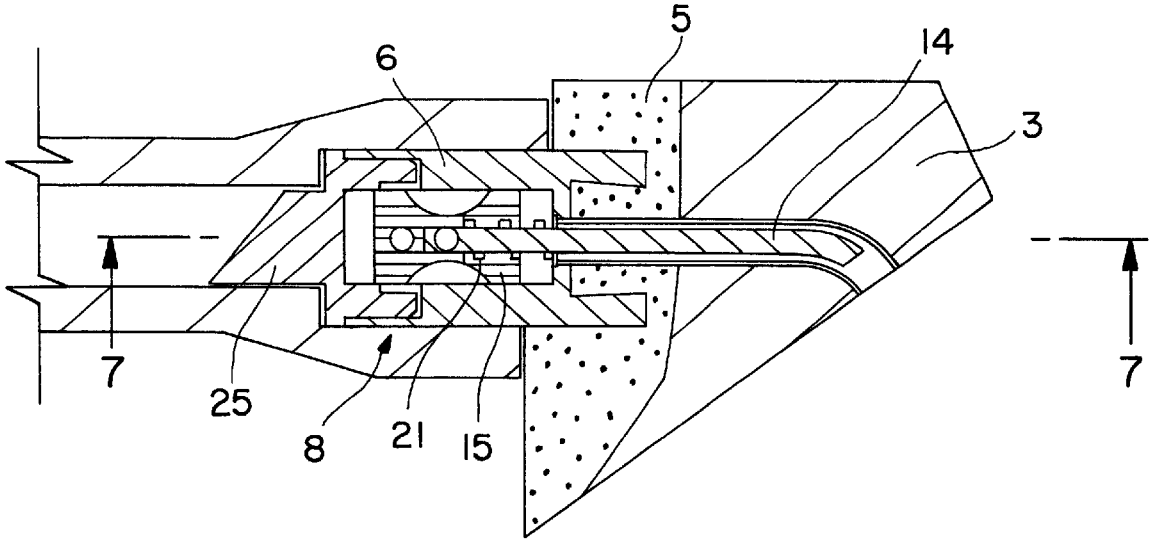
FIG. 6 is a longitudinal section through a remaining part of the locking device according to the present invention when the rest of the locking device has been removed in order to achieve access to the weapon.
Figure 7:
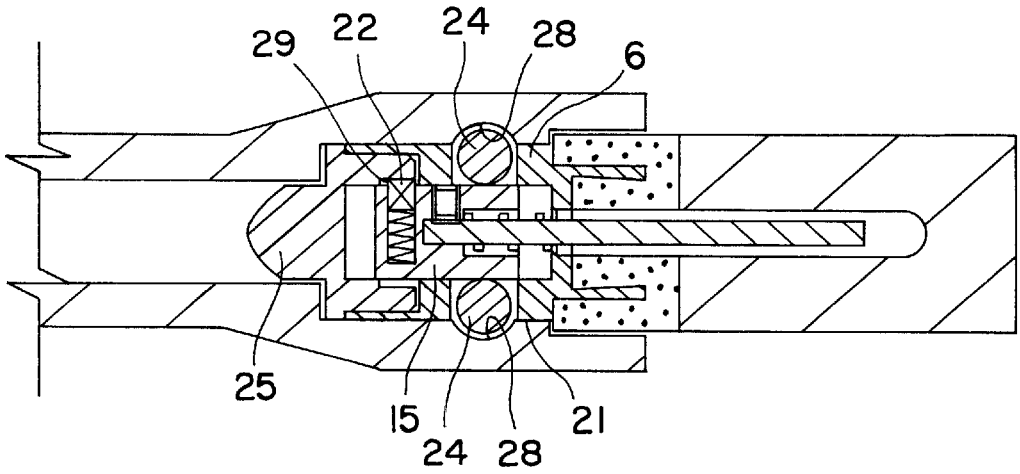
FIG. 7 is a section along 7—7 in FIG. 6.

As is most evident from FIG. 5 certain portions of the cartridge chamber 27 overlap the second portion 5 of the carrier 1, i.e., that portion that preferably is manufactured from sintered cemented carbide. It is a generally known rule that damage upon the cartridge chamber 27 must not be done in order to get access to a weapon that is protected by a locking device. This means that damage in order to remove the locking device according to the present invention must be made to the right of the cartridge chamber 27 according to FIG. 5. As is evident from FIG. 5 the second portion 5 has such an extension in the area of the right end of the cartridge chamber 27 in FIG. 5 that if a cutting-off of the first portion is effected, e.g., by a cross-cutting saw as illustrated in FIGS. 6 and 7, the right end of the cartridge chamber 27 is still embedded in the second portion 5. If putting in some effort it is possible to cut in SANCIC® material, it is however in principle impossible a to bore in SANCIC® materials this being the alternative that is offered if an attempt is made to remove the blocking element 8 when continuing from the situation according to FIGS. 6 and 7. In this connection it should be mentioned that upon the end portion of the casing 6 that is embedded in the second portion 5 granules of cemented carbide are embedded, this reinforcing the end portion against boring. Otherwise the casing 6 is normally manufactured from a free cutting steel.

With reference to FIGS. 6 and 7 the locked position will be described that the lock plunger 15 assumes, if the wire 14 is cut off. As is evident from FIGS. 6 and 7 the lock Plunger 15 will be displaced to the left by the spring 21 since the cut off wire 14 does not counteract such a displacement. Thereby, the spring-activated pin 22 will engage an internal groove 29 in the transition between the casing 6 and the front portion 25 and fix the lock plunger 15 axially in the position displaced to the left in FIGS. 6 and 7. This means that even if the lock plunger 15 is turned by means of the cut-off wire 14 the locking rollers 24 will permanently be located in the second recesses 28 since a cylindrical portion of the further inserted lock plunger 15 abuts the locking rollers 24. The blocking element 8 is thus in an extremely efficient way secured in the cartridge chamber 27 even if the wire 14 is cut off.

With reference to FIGS. 4–7 it will be described what happens if the locking mechanism 9 in an unjustified way is removed from the recess 7, e.g. by boring. In such a case the first abutment 12, supported by the locking mechanism 9, will give away for the pressure force from the pressure spring 11. This means that the force, exerted by the pressure spring 11 upon the anchoring element 13, ceases and that the anchoring of the wire 14 also ceases. Thus the course described above, j.,n connection with the cutting-off of the wire 14, will in principle be repeated, the difference however being that when the locking mechanism 9 is bored the wire 14 will be released instead of being cut off.

Thus it should be stated that regardless if the wire 14 is cut off or released, in connection with boring of the locking mechanism 9, the blocking element 8 will assume a locked position in the cartridge chamber 27, the locked position in an extremely efficient way prevents the blocking element 8 from being removed from the cartridge chamber 27.

In the description above of the locking device according to the present invention it is stated that the carrier 1 preferably should consist of a material that is marketed under the trademark SANCIC®. However, the invention is of course not restricted to SANCIC® but more generally expressed the carrier 1 may include a first portion 3 being an irony based casting alloy and a second portion 5 consisting of sintered cemented carbide or pure hard materials of e.g., carbide. In this connection the hard material or the sintered cemented carbide is preferably in the shape of pieces, granulates, powder or the like that are cast integral with the casting alloy.

Although the preferred embodiment according to the present invention is to embed one end of the blocking element 8 in cemented carbide it is also feasible within the scope of the invention to have the carrier made out of steel, that a hole is drilled in the carrier, that the hole completely or partly is lined with cemented carbide, that one end of the blocking element is mounted in the lined hole and that the blocking element 8 is fixed to the carrier, e.g., by welding.

It may vary how large part of the carrier 1 the second portion 5 of cemented carbide constitutes and what is shown in the Figures is only an example. If the locking device according to the present invention should be made even more difficult to force then the locking device is modified in such a way that the second portion 5 constitutes a larger portion of the carrier 1.

Instead of increasing the continuous volume of the second portion 5 it is also feasible that separate further portions of cemented carbide or other hard materials are provided in the carrier 1 at certain exposed portions.

In the embodiment described above a manually operated locking mechanism 9 is mounted in the first recess 7. Within the scope of the invention it is also feasible that the manually operated locking mechanism 9 is replaced by an electric motor having a gear box and a position indicator, the shaft of the electric motor being connected with the wire 14 for turning the wire 14. The electric motor may be provided with a code locking means in order to prevent that the electric motor is activated by unauthorized persons.

Generally, modifications may be present as regards the means that actuates the elements belonging to the blocking element 8, e.g., the lock plunger 15 and the locking rollers 24. However, an essential feature of the locking device according to the present invention is that the portion of the blocking element 8 that is embedded in the carrier 1 is effectively protected against outer unjustified damage, e.g., cutting off by a cross-cutting saw or boring.

The releasing mechanism 10 described above may also be used in other applications than with a locking device of the kind that the present invention relates to. An example of such a different application is safes. In such a case it is possible that the displacement of the lock plunger 15, in connection with activation of the releasing mechanisms 10, results in a wanted locking interaction by other locking means than the locking rollers 24 according to the present invention.

While this invention has been illustrated and described in accordance with a preferred embodiment, it is recognized that variations and changes may be made therein without departing from the invention as set forth in the claims.

What is claimed is:

1. A weapon having a locking device, comprising:

a carrier that is receivable in a holder for an ammunition box of the weapon;

a blocking element, the blocking element being supported by the carrier, the blocking element being mountable in a cartridge chamber of the weapon, the blocking element being movable between a released position relative to the cartridge chamber and a locked position relative to the cartridge chamber;

an actuator disposed in the carrier; and a power transmission extending between the blocking element and the actuator, at least a portion of the power transmission being flexible, wherein a portion of the blocking element is received in the carrier and is at least partly surrounded by protective material.

2. The weapon having a locking device according to claim 1, wherein a portion of the blocking element is embedded in a portion of the carrier, the portion of the carrier including a protective material.

3. The weapon having a locking device according to claim 1, further comprising a locking mechanism arranged to prevent access to the actuator.

4. The weapon having a locking device according to claim 3, further comprising a key to the locking mechanism for actuating the actuator.

5. A weapon having a locking device, comprising:

a carrier that is receivable in a holder for an ammunition box of the weapon;

a blocking element, the blocking element being supported by the carrier, the blocking element being mountable in a cartridge chamber of the weapon, the blocking element being movable between a released position relative to the cartridge chamber and a locked position relative to the cartridge chamber;

an actuator disposed in the carrier; and a power transmission extending between the blocking element and the actuator, wherein a portion of the blocking element is received in the carrier and is at least partly surrounded by protective material, wherein the power transmission includes a wire, one end of the wire being connected with the blocking element and another end of the wire being connected with the actuator, the actuator including a portion rotatable relative to the carrier.

6. The weapon having a locking device according to claim 5, wherein the wire is rotationally fixed to a lock plunger, the lock plunger being rotatable relative to the blocking element, the lock plunger cooperating with at least one locking element when the blocking element is in the locked position.

7. The weapon having a locking device according to claim 6, wherein the lock plunger is urged by a spring toward an end of the blocking element that faces away from the wire.

8. The weapon having a locking device according to claim 5, wherein an end of the wire remote from the blocking element is anchored by a spring.

9. The weapon having a locking device according to claim 8, wherein the spring exerts pressure against an abutment.

10. A weapon having a locking device, comprising:

a carrier that is receivable in a holder for an ammunition box of weapon;

a blocking element, the blocking element being supported by the carrier, the blocking element being mountable in a cartridge chamber of the weapon, the blocking element being movable between a released position relative to the cartridge chamber and a locked position relative to the cartridge chamber;

an actuator disposed in the carrier; and a power transmission extending between the blocking element and the actuator, wherein a portion of the blocking element is received in the carrier and is at least partly surrounded by protective material, wherein the carrier includes a first portion of spheroidal graphite iron and a second portion including protective material.

11. A weapon having a locking device, comprising:

a carrier that is receivable in a holder for an ammunition box of the weapon;

a blocking element, the blocking element being supported by the carrier, the blocking element being mountable in a cartridge chamber of the weapon, the blocking element being movable between a released position relative to the cartridge chamber and a locked position relative to the cartridge chamber;

an actuator disposed in the carrier; and a power transmission extending between the blocking element and the actuator, wherein a portion of the blocking element is received in the carrier and is at least partly surrounded by protective material, wherein a portion of the blocking element is embedded in a portion of the carrier, the portion of the carrier including a protective material, and wherein the power transmission includes a wire, one end of the wire being connected with the blocking element and another end of the wire being connected with the actuator, the actuator including a portion rotatable relative to the carrier.

12. The weapon having a locking device according to claim 11, wherein the wire is rotationally fixed to a lock plunger, the lock plunger being rotatable relative to the blocking element, the lock plunger cooperating with at least one locking element when the blocking element is in the locked position.

13. The weapon having a locking device according to claim 12, wherein the lock plunger is urged by a spring toward an end of the blocking element that faces away from the wire.

14. The weapon having a locking device according to claim 11, wherein an end of the wire remote from the blocking element is anchored by a spring.

15. The weapon having a locking device according to claim 14, wherein the spring exerts pressure against an abutment.

* * * * *